US009670727B2

(12) United States Patent
Phung et al.

(10) Patent No.: US 9,670,727 B2
(45) Date of Patent: Jun. 6, 2017

(54) DOWNHOLE MOTOR COUPLING SYSTEMS AND METHODS

(71) Applicant: National Oilwell Varco, L.P., Houston, TX (US)

(72) Inventors: Dong P. Phung, Spring, TX (US); Sorin Gabriel Teodorescu, The Woodlands, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 552 days.

(21) Appl. No.: 14/445,298

(22) Filed: Jul. 29, 2014

(65) Prior Publication Data

US 2015/0034388 A1 Feb. 5, 2015

Related U.S. Application Data

(60) Provisional application No. 61/860,490, filed on Jul. 31, 2013.

(51) Int. Cl.
*E21B 17/03* (2006.01)
*E21B 17/04* (2006.01)
(Continued)

(52) U.S. Cl.
CPC ..... *E21B 4/006* (2013.01); *F04C 2/1073* (2013.01); *F04C 13/008* (2013.01); *F04C 15/0065* (2013.01)

(58) Field of Classification Search
CPC . E21B 4/02; E21B 4/006; E21B 7/068; F04C 13/008; F04C 15/0065; F04C 2/1073
See application file for complete search history.

(56) References Cited

U.S. PATENT DOCUMENTS 3,242,694 A * 3/1966 Schmidt ..... B21B 35/14 180/349
3,407,628 A * 10/1968 Eccher ..... F16D 3/04 464/103

(Continued)

OTHER PUBLICATIONS

Canadian Patent Application No. 2,858,023 Office Action dated Nov. 13, 2015 (4 pages).

(Continued)

*Primary Examiner* — Daniel P Stephenson
(74) *Attorney, Agent, or Firm* — Conley Rose, P.C.

(57) ABSTRACT

A drilling system includes a drillstring and a power section further including a stator having a stator axis and a rotor within the stator. The rotor rotates eccentrically within the stator in response to fluid flowing therebetween. Additionally, the system includes a coupling section including first, second, and third rotation members having a first, second, and third axes, respectively. The third rotation member is coupled to the first and second rotation members. The third rotation member is configured to move radially relative to the first and second rotation members as the first, second, and third rotation members rotate about the first, second, and third axes, respectively. Further, the system includes an input shaft coupled to the rotor and first rotation member. The input shaft and first rotation member rotate with the rotor eccentrically to the stator axis and the second rotation member rotates concentrically about the stator axis.

20 Claims, 9 Drawing Sheets

(51) Int. Cl.

| | |
|---|---|
| ***E21B 4/00*** | (2006.01) |
| ***F04C 13/00*** | (2006.01) |
| ***F04C 2/107*** | (2006.01) |
| ***F04C 15/00*** | (2006.01) |

(56) References Cited

U.S. PATENT DOCUMENTS

| | | | | |
|---|---|---|---|---|
| 3,664,153 | A * | 5/1972 | Sugahara | F16D 3/04 464/102 |
| 4,484,899 | A * | 11/1984 | Haarmann | F16D 3/04 464/102 |
| 4,732,491 | A | 3/1988 | Geczy | |
| 5,000,723 | A | 3/1991 | Livingstone | |
| 5,135,060 | A | 8/1992 | Ide | |
| 5,139,400 | A * | 8/1992 | Ide | E21B 4/02 175/107 |
| 5,248,896 | A * | 9/1993 | Forrest | F03B 13/02 175/107 |
| 5,325,714 | A * | 7/1994 | Lende | E21B 4/02 166/349 |
| 6,183,226 | B1 * | 2/2001 | Wood | E21B 4/02 418/152 |
| 6,899,075 | B2 * | 5/2005 | Saint-Hilaire | F02B 55/14 123/241 |
| 7,553,138 | B2 * | 6/2009 | Gorban | F01C 1/107 418/48 |
| 7,814,993 | B2 | 10/2010 | White | |
| 7,900,720 | B2 | 3/2011 | Hall et al. | |
| 8,033,917 | B2 | 10/2011 | Prill et al. | |
| 2006/0237234 | A1 * | 10/2006 | Dennis | E21B 4/02 175/95 |
| 2010/0040498 | A1 * | 2/2010 | Akamatsu | F01C 21/02 418/48 |
| 2010/0276500 | A1 * | 11/2010 | Rivlin | G05D 23/1393 236/12.12 |
| 2012/0063941 | A1 * | 3/2012 | Overmeier | F04C 2/1073 418/48 |
| 2013/0048384 | A1 * | 2/2013 | Jarvis | E21B 4/02 175/61 |
| 2014/0028293 | A1 * | 1/2014 | Johnson | E21B 4/02 324/167 |
| 2015/0034388 | A1 * | 2/2015 | Phung | E21B 4/006 175/57 |
| 2016/0177627 | A1 * | 6/2016 | Vail, III | E21B 4/003 175/57 |
| 2016/0208556 | A1 * | 7/2016 | Gawski | E21B 4/02 |
| 2016/0281449 | A1 * | 9/2016 | Lorenson | E21B 4/02 |
| 2016/0326811 | A1 * | 11/2016 | SadAbadi | E21B 4/006 |
| 2016/0356135 | A1 * | 12/2016 | Heizinger | E21B 43/121 |
| 2017/0023068 | A1 * | 1/2017 | Maw | F16D 3/185 |

OTHER PUBLICATIONS

ABSSAC Schmidt Kupplung Catalogue, 24 pages, available at http://www.abssac.co.uk/s/Schmidt+Kupplung/3/48/.

* cited by examiner

DOWNHOLE MOTOR COUPLING SYSTEMS AND METHODS

CROSS-REFERENCE TO RELATED APPLICATIONS

This application claims benefit of U.S. provisional patent application Ser. No. 61/860,490 filed Jul. 31, 2013, and entitled "Downhole Motor Coupling Systems and Methods," which is hereby incorporated herein by reference in its entirety for all purposes.

STATEMENT REGARDING FEDERALLY SPONSORED RESEARCH OR DEVELOPMENT

Not applicable.

BACKGROUND

The invention relates generally to downhole motors. More particularly, the invention relates to coupling devices for converting the eccentric rotation of the rotor of a downhole motor into concentric rotation.

In drilling a borehole (or wellbore) into the earth, such as for the recovery of hydrocarbons or minerals from a subsurface formation, it is conventional practice to connect a drill bit onto the lower end of a "drill string", then rotate the drill bit while applying weight-on-bit to allow the bit to progress downward into the earth along a predetermined path to form a borehole. A typical drill string is made up from an assembly of drill pipe sections connected end-to-end, plus a "bottom hole assembly" (BHA) disposed between the bottom of the drill pipe sections and the drill bit. The BHA is typically made up of sub-components such as drill collars, stabilizers, reamers and/or other drilling tools and accessories, selected to suit the particular requirements of the well being drilled.

The drill string and bit are often rotated by means of either a "rotary table" or a "top drive" associated with a drilling rig erected at the ground surface over the borehole (or in offshore drilling operations, on a seabed-supported drilling platform or suitably-adapted floating vessel). During the drilling process, a drilling fluid (commonly referred to as "drilling mud" or simply "mud") is pumped under pressure downward from the surface through the drill string, out the drill bit into the wellbore, and then upward back to the surface through the annular space ("wellbore annulus") between the drill string and the wellbore. The drilling fluid carries borehole cuttings to the surface, cools the drill bit, and forms a protective cake on the borehole wall (to stabilize and seal the borehole wall), as well as other beneficial functions. At the surface the drilling fluid is treated, by removing borehole cuttings, amongst other possible treatments, then re-circulated by pumping it downhole under pressure through the drill string.

As an alternative to rotation by a rotary table or top drive alone, a drill bit can also be rotated using a "downhole motor" incorporated into the drill string immediately above the drill bit. The technique of drilling by rotating the drill bit with a downhole motor without rotating the drill string is commonly referred to as "slide" drilling. It is common in certain types of well-drilling operations to use both slide drilling and drill string rotation, at different stages of the operation. The use of downhole motors has generally increased in recent years due, at least in part, to their employment in the drilling of wellbores directionally, since downhole motors provide some advantages in such applications.

The downhole motor, which may also be referred to as a mud motor or progressive displacement motor (PDM), converts hydraulic energy of a fluid such as drilling mud into mechanical energy in the form of rotational speed and torque output, which may be harnessed for a variety of applications such as downhole drilling. A typical downhole motor includes a hydraulic drive section, a drive shaft assembly, and a bearing assembly. The hydraulic drive section, also known as a power section or rotor-stator assembly, includes a helical rotor rotatably disposed within a stator, the driveshaft assembly includes a driveshaft rotatably disposed within a driveshaft housing, and the bearing assembly includes a mandrel rotatably supported within a housing. The lower end of the rotor is connected to the upper end of the driveshaft, the lower end of the driveshaft is connected to the upper end of the mandrel, and the lower end of the mandrel is coupled to a drill bit. During drilling operations, the high pressure drilling fluid is pumped under pressure down the drillstring and between the rotor and stator, causing the rotor to rotate relative to the stator. Rotation of the rotor drives the rotation of the driveshaft, the mandrel, and the drill bit.

The central axis of the rotor is typically radially offset from the central axis of the stator by a fixed value known as the "eccentricity." As a result, the rotor rotates eccentrically within the stator. However, many components of the BHA and drill string which utilize the torque generated by the downhole motor (e.g., power generators, drill bit, etc.) are aligned with the central axis of the drill string and stator. Thus, to utilize the torque supplied by the downhole motor the eccentric motion of the rotor is converted to concentric rotation via the driveshaft.

BRIEF SUMMARY OF THE DISCLOSURE

Some embodiments are directed to a downhole power generation assembly. In an embodiment, the downhole power generation assembly includes a generator. In addition, the downhole power generation assembly includes a first shaft coupled to the generator. The first shaft has a first central axis, and rotation of the first shaft is configured to drive the generator to produce power. Further, the downhole power generation assembly includes a second shaft having a second central axis that is oriented parallel to the first central axis and radially offset from the first central axis. The second shaft is configured to be coupled to an end of a rotor of a downhole motor. Still further, the downhole power generation assembly includes a coupling section coupling the first shaft to the second shaft and configured to transfer rotational torque from the second shaft to the first shaft. The coupling section includes a first rotation member coupled to the first shaft and coaxially aligned with the first central axis. In addition, the coupling section includes a second rotation member coupled to the second shaft and coaxially aligned with the second central axis. Further, the coupling section includes a third rotation member axially positioned between the first rotation member and the second rotation member. The third rotation member is coupled to the first rotation member and the second rotation member. The third rotation member has a third central axis oriented parallel to the first central axis and the second central axis. The third rotation member is configured move radially relative to the first rotation member and the second rotation member as each of the first rotation member, second rotation member, and third rotation member rotate about the first central axis, the second central axis, and the third central axis, respectively.

Other embodiments are directed to a drilling system. In an embodiment, the drilling system includes a drillstring. In addition, the drilling system includes a power section coupled to a lower end of the drillstring. The power section includes a stator having a central axis, and a rotor rotatably disposed in the stator, wherein the rotor has a central axis that is oriented parallel to the central axis of the stator and radially offset from the central axis of the stator. The rotor is configured to rotate eccentrically relative to the stator in response to the flow of drilling fluid therebetween. Further, the drilling system includes a coupling section, further including a first rotation member having a first rotation axis. In addition, the coupling section includes a second rotation member axially spaced from the first rotation member and having a second rotation axis. Further, the coupling section includes a third rotation member axially positioned between the first rotation member and the second rotation member and having a third rotation axis, wherein the third rotation member is coupled to the first rotation member and the second rotation member. The first rotation axis, the second rotation axis, and the third rotation axis are each oriented parallel to the central axis of the stator. The third rotation member is configured to move radially relative to the first rotation member and the second rotation member as each of the first rotation member, the second rotation member, and the third rotation member rotate about the first rotation axis, the second rotation axis, and the third rotation axis, respectively. Still further, the drilling system includes an input shaft having a first end coupled to the rotor and a second end coupled to the first rotation member. The input shaft and the first rotation member are configured to rotate with the rotor eccentrically relative to the central axis of the stator and the second rotation member is configured to rotate concentrically relative to the central axis of the stator and the second rotation axis.

Still other embodiments are directed to a method for rotating a downhole component concentrically relative to a central axis of a drill string. In an embodiment, the method includes (a) flowing fluid through a stator having a rotor rotatably disposed therein, wherein the stator has a central stator axis and the rotor has a central rotor axis that is radially offset from the central axis of the stator. In addition, the method includes (b) rotating the rotor about the rotor axis and orbiting the rotor axis about the stator axis during (a). Further, the method includes (c) rotating a first rotation member that is coupled to the rotor about the rotor axis during (b). Still further, the method includes (d) rotating a second rotation member, that is coupled to the first rotation member with a first plurality of connection links, about an axis of rotation that is parallel and radially offset from each of the rotor axis and the stator axis during (b). Also, the method includes (e) rotating a third rotation member, that is coupled to the second rotation member with a second plurality of connection links, about the stator axis during (b), and (f) radially moving the second rotation member relative to the first rotation member and the second rotation member during (b).

Embodiments described herein comprise a combination of features and advantages intended to address various shortcomings associated with certain prior devices, systems, and methods. The foregoing has outlined rather broadly the features and technical advantages disclosed herein in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes as disclosed herein. It should also be realized by those skilled in the art that such equivalent constructions do not depart from the spirit and scope set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
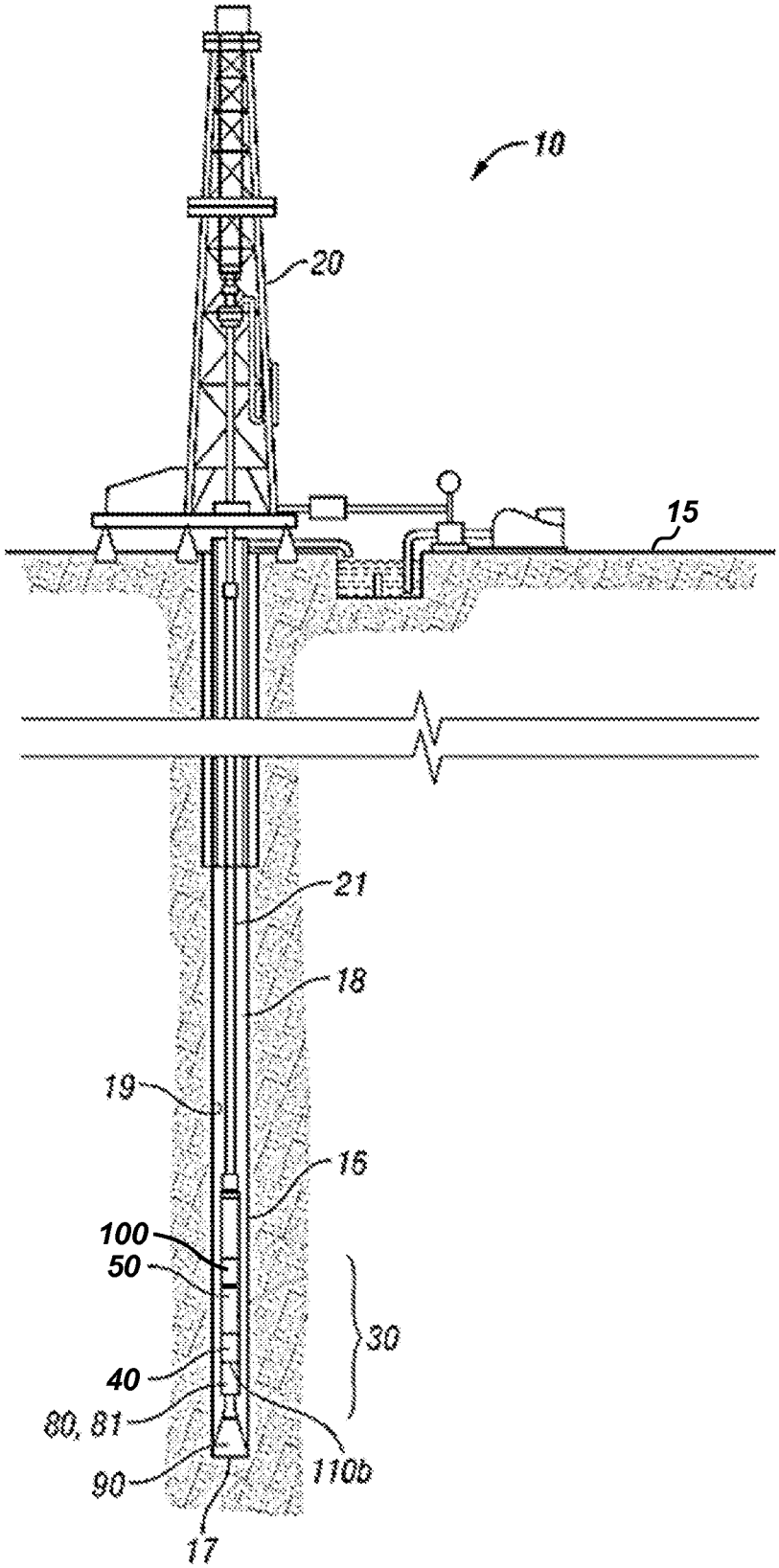
FIG. 1 is a schematic partial cross-sectional view of a system for drilling a borehole into an earthen formation in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, a system 10 for drilling a borehole 16 in an earthen formation is shown. In this embodiment, system 10 includes a drilling rig 20 disposed at the surface 15, a drill string 21 extending from rig 20 into borehole 16, a downhole motor 30, and a drill bit 90. Motor 30 forms a part of the bottomhole assembly ("BHA") and is disposed between the lower end of the drill string 21 and drill bit 90. Moving downward along the BHA towards bit 90, motor 30 includes a power generation assembly 100 in accordance with the principles disclosed herein, a hydraulic drive or power section 50, a driveshaft assembly 40 coupled to power section 50, and a bearing assembly 80 coupled to driveshaft assembly 40. Bit 90 is coupled to the lower end of bearing assembly 80.

The hydraulic drive section 50 converts pressure exerted by drilling fluid pumped down drill string 21 into rotational torque that is transferred through driveshaft assembly 40 and bearing assembly 80 to drill bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drill string 21 and through motor 30 passes out of the face of drill bit 90 and back up the annulus 18 formed between drill string 21 and the sidewall 19 of borehole 16. The drilling fluid cools the bit 90, and flushes the cuttings away from the face of bit 90 and carries the cuttings to the surface.

Figure 2:
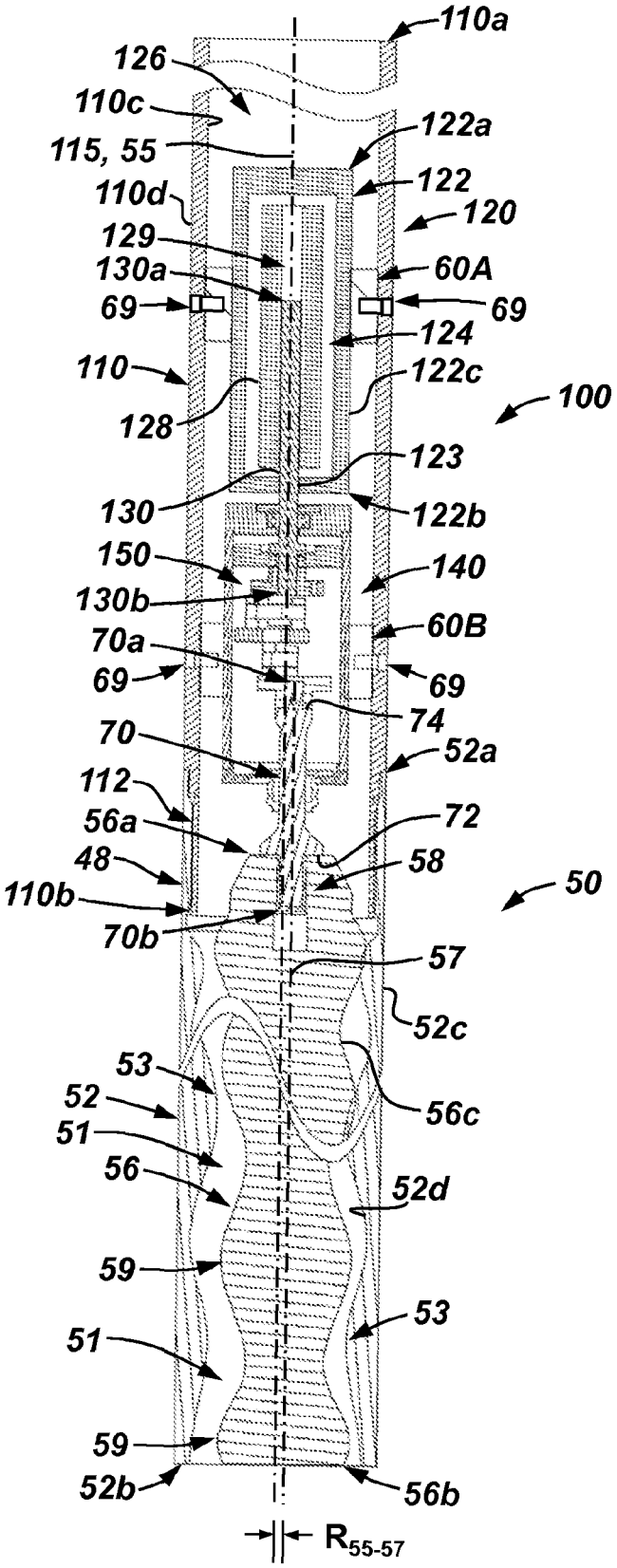
FIG. 2 is a schematic cross-sectional view of the power section and the power generation assembly of the system of FIG. 1.

Referring now to FIG. 2, power section 50 generally includes a stator 52 and a rotor 56 rotatably disposed within stator 52. Stator 52 has a central or longitudinal axis 55, a first or uphole end 52*a*, a second or downhole end 52*b* opposite the uphole end 52*a*, a radially outer surface 52*c* extending axially between the ends 52*a*, 52*b*, and a radially inner surface 52*d* extending axially between the ends 52*a*, 52*b*. Radially outer surface 52*c* is generally cylindrical, however, the radially inner surface 52*d* includes a plurality of stator lobes 53 extending helically about axis 55 between the ends 52*a*, 52*b*. In this embodiment, uphole end 52*a* comprises an internally threaded female box-end connector 48 that receives and threadably engages a housing 110 of a power generation assembly 100 axially adjacent power section 50.

Rotor 56 has a central or longitudinal axis 57, a first or uphole end 56*a*, a second or downhole end 56*b* opposite the uphole end 56*a*, and a radially outer surface 56*c* extending axially between the ends 56*a*, 56*b*. Axis 57 is oriented parallel to and radially offset from axis 55 of stator 52. In particular, axis 57 is radially offset from axis 55 by a radius $R_{55\text{-}57}$. Radially outer surface 56*c* of rotor 56 includes a plurality of rotor lobes 59 that extend helically about axis 57 between ends 56*a*, 56*b*. When rotor 56 is received within stator 52, lobes 59 of rotor 56 engage and intermesh with mating lobes 53 of stator 52, thereby defining a plurality of discrete pockets or cavities 51. An internally threaded counterbore 58 extends axially from uphole end 52*a*.

An input shaft 70 is coupled to the uphole end 56*a* of rotor 56 and is coaxially aligned with axis 57. Shaft 70 has an externally threaded first or uphole end 70*a* and an externally threaded second or downhole end 70*b* opposite the uphole end 70*a*. In addition, shaft 70 includes a first or downhole annular shoulder 72 positioned proximate downhole end 70*b*, and a second or uphole annular shoulder 74 positioned between shoulder 72 and end 70*a*. Downhole end 70*b* of shaft 70 is threadably received within counterbore 58 and shoulder 72 axially abuts uphole end 56*a* of rotor 56.

During operation, fluid (e.g., drilling mud) is pumped downhole and routed between the radially outer surface 56*c* of rotor 56 and the radially inner surface 52*d* of stator 52 such that cavities 51 are filled with the fluid and exert pressure on both surface 56*c* of rotor 56 and surface 52*d* of stator 52. This pressure causes rotor 56 to rotate about axis 57 and simultaneously causes axis 57 of rotor 56 to rotate or orbit about axis 55 of stator 52. Since shaft 70 is coaxially aligned with rotor 56 and fixably coupled thereto, shaft 70 rotates along the same eccentric path as rotor 56. Thus, flowing or pumping of drilling fluid through power section 50 results in an eccentric rotation of rotor 56 and shaft 70 about the axis 55 of stator 52. As will be explained in more detail below, a power generation assembly 100 coupled to power section 50 includes a coupling assembly 150 that converts the eccentric rotation of rotor 56 and shaft 70 into concentric rotation about the axis 55.

Referring still to FIG. 2, power generation assembly 100 is positioned axially adjacent and uphole of power section 50. In this embodiment, assembly 100 includes an outer housing 110, a generator 120, a coupling section 140, and an output shaft 130. Generator 120, coupling section 140, and shaft 130 are each disposed within housing 110. Output shaft 130 extends axially between coupling section 140 and generator 120, and transfers rotational torque to drive generator 120.

Outer housing 110 has a central or longitudinal axis 115 coaxially aligned with stator axis 55, a first or uphole end 110*a*, a second or downhole end 110*b* opposite the uphole end 110*a*, a radially outer surface 110*c* extending axially between ends 110*a*, 110*b*, and a radially inner surface 110*c* extending axially between ends 110*a*, 110*b* Inner surface 110*c* defines a throughbore 126 that extends axially between ends 110*a*, 110*b*. In this embodiment, downhole end 110*b* comprises an externally threaded male pin-end connector 112 that threadably mates and engages the internally threaded box-end connector 48 of stator 52, thereby coupling stator 52 and housing 110.

Referring still to FIG. 2, generator 120 produces power (e.g., electrical, hydraulic, etc.) for downhole use. In general, generator 120 can be any downhole generator known in the art. In this embodiment, generator 120 includes a can or housing 122 coaxially disposed within throughbore 126 and a power generation assembly 128 disposed within housing 122. The radial position of generator 120 within housing 110 is maintained by a first or upper centralizer 60A described in more detail below.

Figure 3:
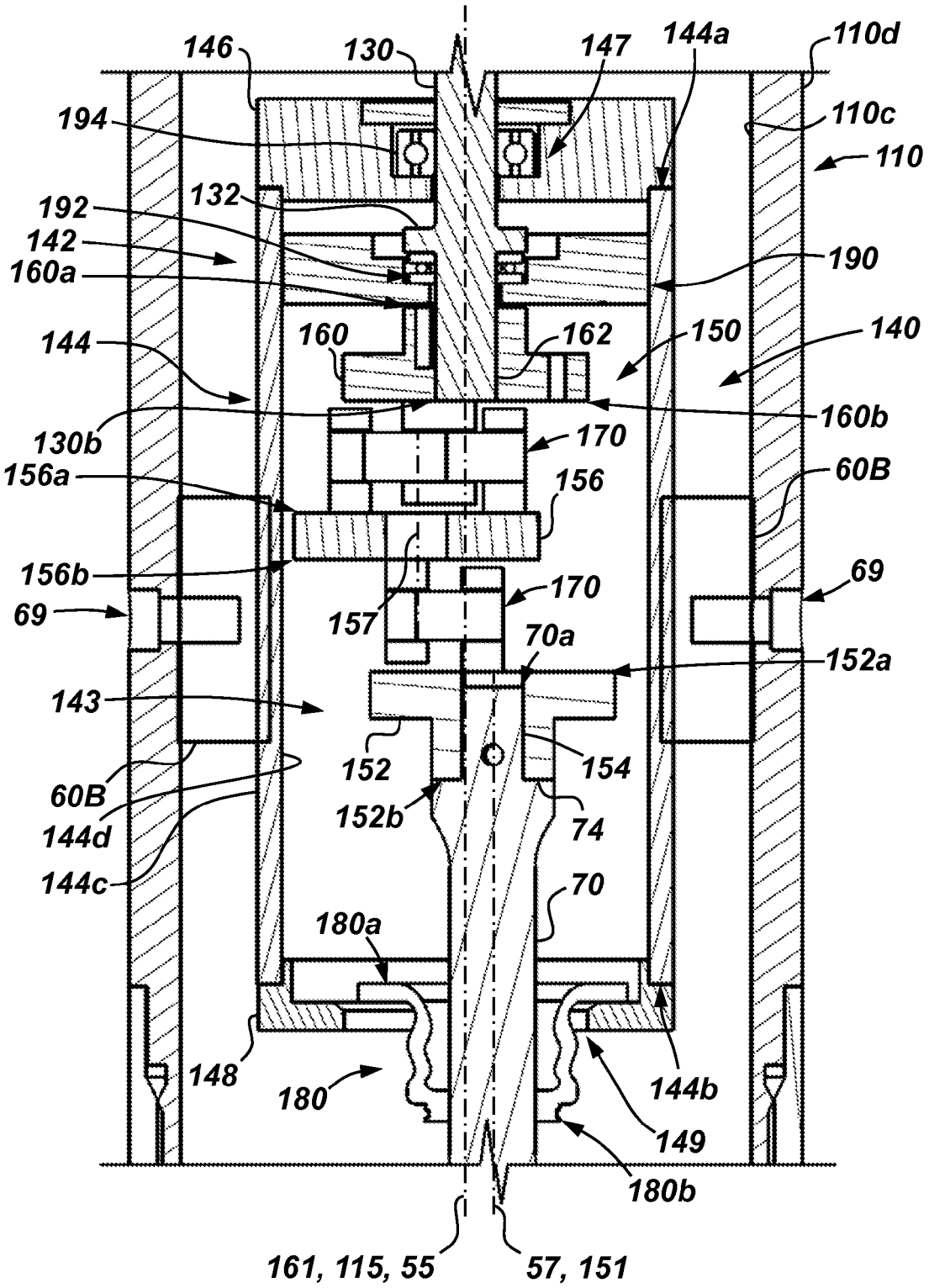
FIG. 3 is a is an enlarged, schematic cross-sectional view of the coupling section of the power generation assembly of FIG. 1.

Generator housing 122 has a first or uphole end 122*a*, a second or downhole end 122*b* opposite the uphole end 122*a*, a radially outer surface 122*c* extending axially between the ends 122*a*, 122*b*, and an inner cavity 124. A port 123 extends axially through downhole end 122*b* to cavity 124. Assembly 128 is disposed within cavity 124 and includes a central receiving region 129 coaxially aligned with axis 115 and port 123. Shaft 130 has a first or uphole end 130*a*, a second or downhole end 130*b* opposite the uphole end 130*a*, and as best shown in FIG. 3, a radially extending circumferential shoulder 132 axially positioned between the ends 130*a*, 130*b* and proximate the downhole end 130*b*. Referring again to FIG. 2, shaft 130 extends through port 123 such that uphole end 130*a* is received within region 129 of assembly 128.

During operations, assembly 128 converts the rotational motion of shaft 130 into either electrical, hydraulic, or some other energy source through any suitable technique known in the art. For example, in some embodiments, assembly 128 comprises coils (e.g., coils of conductive wire) radially separated from and extending substantially helically around shaft 130 within cavity 124. In addition, one or more magnets are disposed on the surface of shaft 130 proximate end 130*a*. During operation, as shaft 130 rotates about the axis 115, the magnets also rotate about axis 115 relative to the coils, thus generating electric current with the coils and thereby also generating electric power for use by other components disposed downhole.

Referring now to FIGS. 2 and 3, in this embodiment, coupling section 140 includes a housing 142 coaxially aligned with axis 115 and a coupling assembly 150 disposed within housing 142. Housing 142 includes a generally cylindrical body 144, a first or uphole cap 146, and a second or downhole cap 148. Together, body 144 and caps 146, 148 define an inner space or cavity 143 within housing 142. As best shown in FIGS. 2 and 3, the radial position of housing 142 within housing 110 is maintained with a second or lower centralizer 60B which is described in more detail below.

Body 144 has a first or uphole end 144*a*, a second or downhole end 144*b* opposite the uphole end 144*a*, a radially outer surface 144*c* extending axially between the ends 144*a*, 144*b*, and a radially inner surface 144*d* also extending axially between the ends 144*a*, 144*b*. Uphole cap 146 is secured to uphole end 144*a* and includes a central passage or port 147 extending axially therethrough. Downhole cap 148 is secured to downhole end 144*b* and includes a central passage or port 149 extending axially therethrough. When caps 146, 148 are secured to body 144, ports 147, 149 are coaxially aligned with axis 115.

Referring specifically to FIG. 3, shaft 70 of power section 50 extends through passage 149 in cap 148 into cavity 143 of housing 142, and shaft 130 extends through passage 147 of cap 146 into cavity 143. Shaft 130 is axially supported within cavity 143 with a thrust bearing 192 disposed within a bearing housing 190 mounted inside cavity 143 and is radially supported with a radial bearing 194 seated within port 147. In particular, radial bearing 194 engages the outer surface of shaft 130 with shoulder 132 axially abutting and engaging thrust bearing 192. As shaft 130 rotates about the aligned axes 55, 115, axial loads transferred to shaft 130 are taken up by thrust bearing 192 (via shoulder 132) and radial loads transferred to shaft 130 are taken up by radial bearing 194.

A sealing boot 180 is disposed about shaft 70 to restrict the ingress of fluids (e.g., drilling mud) into cavity 143 as well as the egress of fluid (e.g., lubricant) from cavity 143. In this embodiment, boot 180 has a first or uphole end 180*a* that sealingly engages cap 148 of housing 142 and a second or downhole end 180*b* that sealingly engages the outer surface of shaft 70. As shaft 70 rotates about axis 57 and orbits about the axis 55, uphole end 180*a* of boot 180 remains substantially static, while downhole end 180*b* flexes and moves in response to the movements of shaft 70. Thus, the contact between boot 180 and cap 148 comprises a static seal while the contact between shaft 70 and downhole end 180*b* of boot 180 comprises a dynamic seal. Boot 180 is made of an elastomeric material (e.g., rubber) that can flex and deform to accommodate the previously described eccentric rotation of shaft 70 during operations. A similar sealing assembly (not shown) is included between aperture 147 of cap 146 and shaft 130 to further limit the ingress and the egress of fluid to and from, respectively, cavity 143 through port 147 of housing 142. In some embodiments, the sealing assembly disposed within port 147 of cap 146 comprises a gland seal, however, in general, any suitable sealing assembly may be used.

Figure 5:
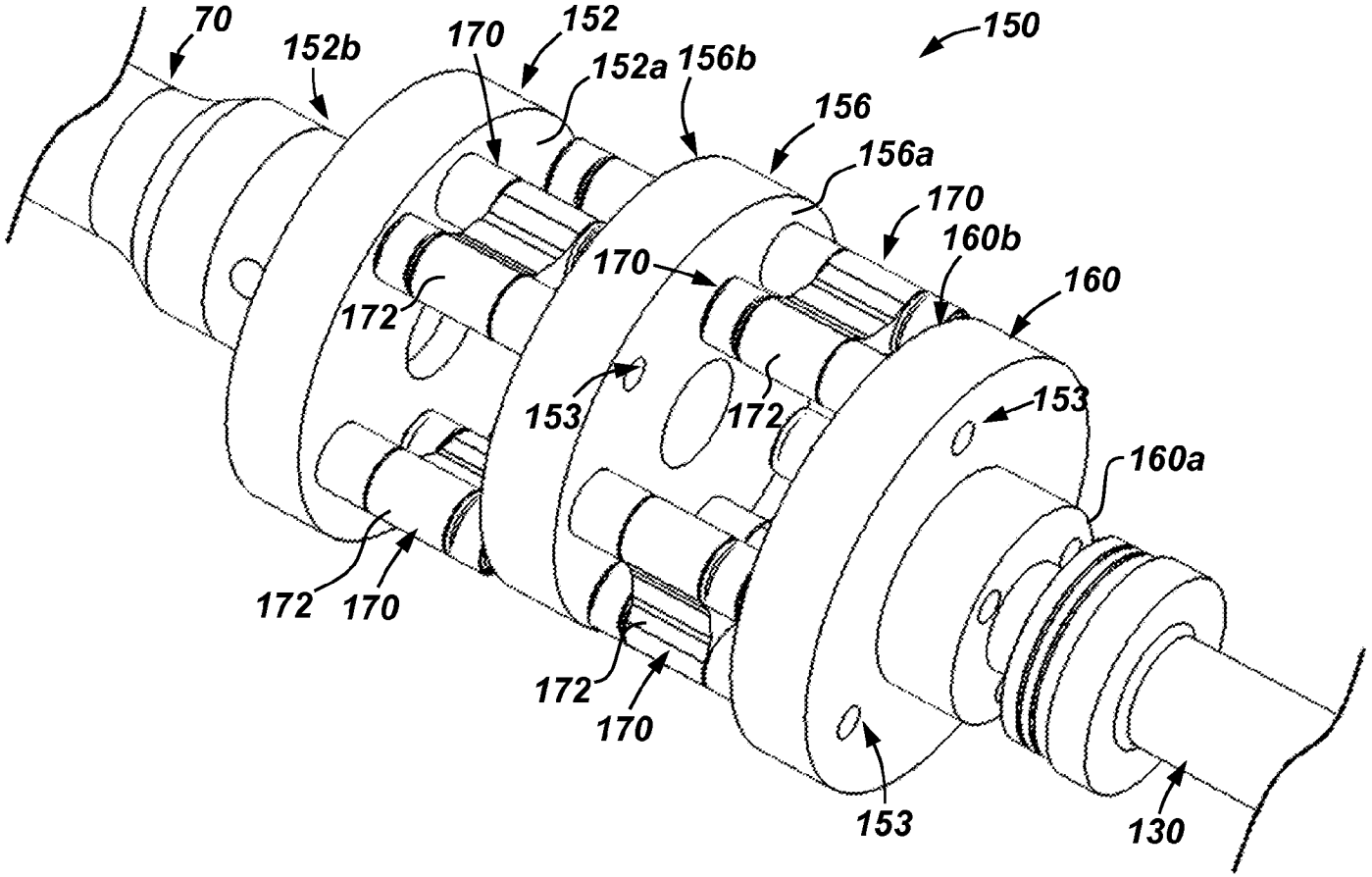
FIG. 5 is a prospective view of the coupling assembly of the coupling section shown in of FIG. 3.
Figure 6:
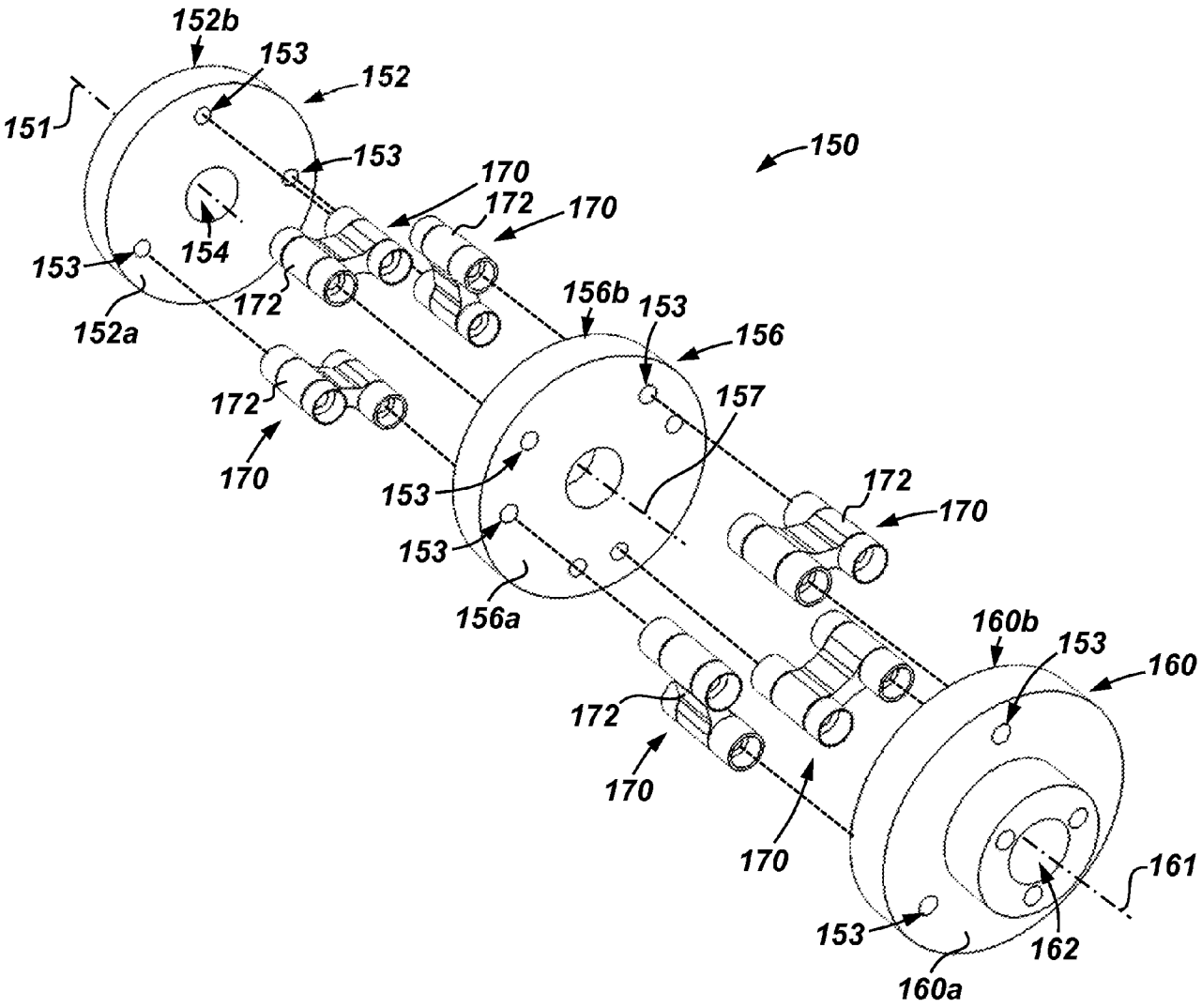
FIG. 6 is an exploded perspective view of the coupling assembly of the coupling section of FIGS. 3 and 5.

Referring now to FIGS. 2, 3, 5, and 6, as previously described, coupling assembly 150 converts the eccentric rotation of rotor 56 and shaft 70 into concentric rotation about the axis 55. In this embodiment, assembly 150 includes a first or lower disk 152, a second or intermediate disk 156 axially positioned uphole of first disk 152, and a third or upper disk 160 axially positioned uphole of disks 152, 156. Thus, intermediate disk 156 is axially positioned between disks 152, 160. The first disk 152 has a first axis of rotation 151, a first or upper side 152*a*, a second or lower side 152*b* opposite the upper side 152*a*, and a central throughbore 154 extending axially between the sides 152*a*, 152*b*. In addition, the second disk 156 has a second axis of rotation 157, a first or upper side 156*a*, and a second or lower side 156*b* opposite the upper side 156*a*. Further, the third disk 160 includes a third axis of rotation 161, a first or upper side 160*a*, a second or lower side 160*b* opposite the upper side 160*a*, and a central throughbore 162 extending axially between the sides 152*a*, 153*b*. As is best shown in FIG. 6, each disk 152, 156, 160 includes a plurality of circumferentially-spaced apertures or bores 153 extending axially therethrough. In this embodiment, disks 152, 160 each include a total of three bores 153, while disk 156 includes a total of six bores 153. As will be described in more detail below, each of the disks 152, 156, 160 are configured to rotate about their respectively rotational axes 151, 157, 161 during operations, and thus, disks 152, 156, 160 may also be referred to herein as rotational or rotating members 152, 156, 160.

Disk axes 151, 157, 161 are oriented parallel to one another. However, as will be described in more detail below, disks 152, 156, 160 are free to translate radially relative to the other disks 152, 156, 160 to a limited degree as each rotates about its axis 151, 157, 161, respectively. Thus, axes 151, 157, 161 can move radially relative to each other.

Figure 7:
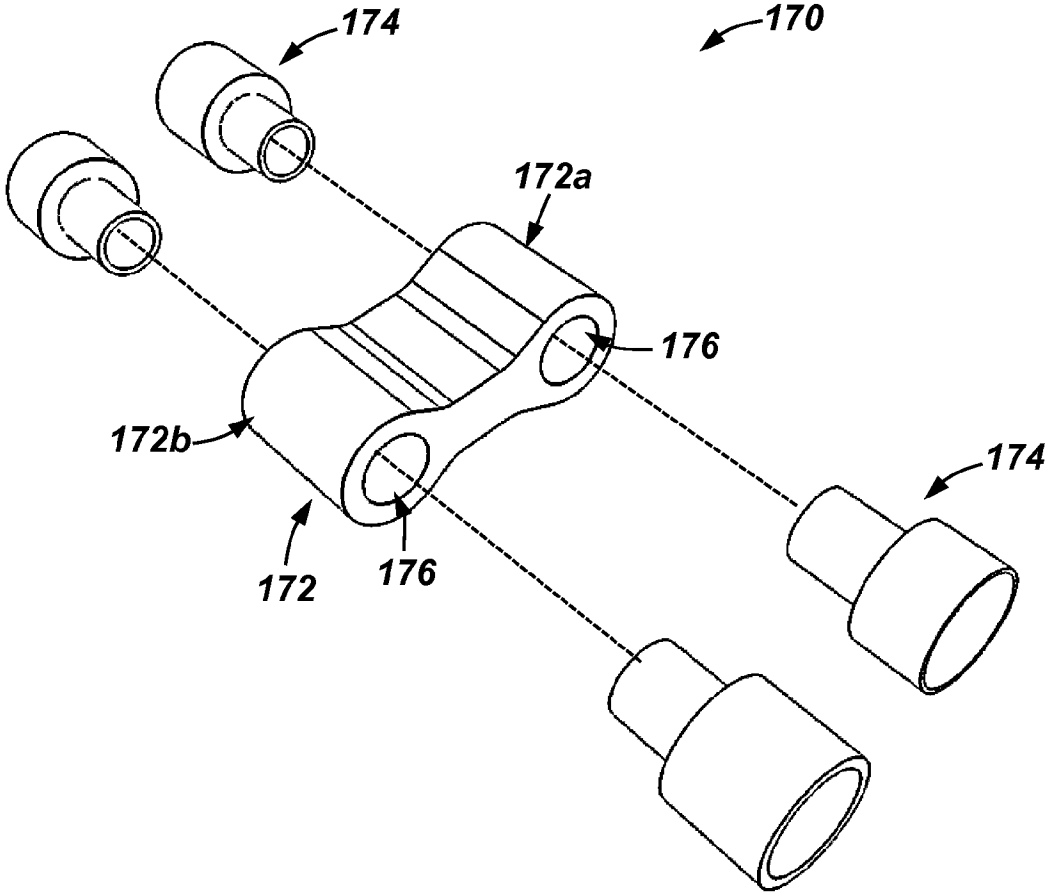
FIG. 7 is an exploded perspective view of one of the connection links of the coupling assembly shown in FIGS. 2, 3, 5, and 6.

Referring now to FIGS. 5, 6, and 7, disks 152, 156, 160 are coupled to one another with a plurality of connection links 170. As best shown in FIG. 7, in this embodiment, each link 170 includes a linking member 172 and a plurality of pins 174 rotatably coupled to member 172. Each link 172 has a first end 172*a* and a second 172*b* opposite the first end 172*a*. A throughbore 176 is provided in each end 172*a*, 172*b*. Throughbores 176 in each member 172 are parallel and radially spaced apart. One pin 174 is rotatably and slidingly received in each throughbore 176.

During assembly, each member 170 is disposed between a pair of axially adjacent disks 152, 156, 160 (e.g., between disks 152, 156 or between disks 156, 160), and each end 172*a*, 172*b* is pivotally coupled to one axially adjacent disk 152, 156, 160 with pins 174. In particular, members 172 are positioned between the pairs of adjacent disks 152, 156, 160 with throughbores 176 oriented parallel to axis 115. The throughbore 176 in end 172*a* is aligned with one bore 153 in one axially adjacent disk 152, 156, 160 and the throughbore 176 in end 172*b* is aligned with one bore 153 in the other axially adjacent disk 152, 156, 160. A coupling member such as, for example, a screw, bolt, rivet, pin or the like extends through each bore 153 and one throughbore 176 of the corresponding member 172 and is secured to pins 174 disposed in that throughbore 176. Thus, each member 172 is free to pivot about one end 172*a* relative to one axially adjacent disk 152, 156, 160 and is free to pivot about the other end 172*b* relative to the other axially adjacent disk 152, 156, 160.

Referring now to FIG. 6, in this embodiment, disk 152 is coupled to axially adjacent disk 156 with a total of three connection links 170 such that the first end 172*a* of each member 172 is rotatably coupled to the disk 152, while the second end 172*b* of each member 172 is rotatably coupled to the disk 156. Thus, when disk 152 is rotated about the first axis of rotation 151, forces are transferred through the linking member 172 of each connection link 170 disposed between the disks 152, 156, thereby rotating disk 156 about the second axis of rotation 157. As a result, disks 152, 156 rotate in a one-to-one relationship, with disk 152 rotating about the axis 151 and disk 156 rotating about the axis 157. Similarly, disk 156 is coupled to disk 160 with a total of three connection links 170 such that the first end 172*a* of each member 172 is rotatably coupled to the disk 156, while the second end 172*b* of each member 172 is rotatably coupled to the disk 160. Thus, when disk 156 is rotated about the second axis of rotation 157, forces are transferred through the linking member 172 of each connection link 170 disposed between the disks 156, 160, thereby rotating disk 160 about the third axis of rotation 161. As a result, disks 156, 160 rotate in a one-to-one relationship, with disk 156 rotating about the second axis of rotation 157 and disk 160 rotating about the third axis of rotation 161. Therefore, when disk 152 is rotated about the first axis of rotation 151, disk 160 is caused to rotate about the third axis of rotation 161 in a one-to-one relationship. Further, because each end 172*a*, 172*b* of each member 172 is rotatably coupled to one disk 152, 156, 160 as previously described, each disk 152, 156, 160 can translate radially relative to the other two disks 152, 156, 160 as each disk 152, 156, 160 rotates about its respective axis 151, 157, 161. In particular, as disk 152 rotates about the axis 151, thus causing disk 156 to rotate about the axis 157, and further causing disk 160 to rotate about the axis 161 as previously described, each disk 152, 156, 160 can translate radially relative to the other disks 152, 156, 160 such that each disk 152, 156, 160 can move within a corresponding plane that is perpendicular to the axes 151, 157, 161.

Referring specifically again to FIG. 3, coupling assembly 150 is disposed within cavity 143 of housing 142 with uphole end 70*a* of shaft 70 seated in throughbore 154 of disk 152 and shoulder 72 axially abutting and engaging end 152*b* of disk 152, and with the axis 57 coaxially aligned with the axis 151. Uphole end 70*a* is secured to disk 152 such that shaft 70 and disk 152 cannot rotate relative to each other (i.e., rotational torque is transferred between shaft 70 and disk 152). In addition, downhole end 130*b* of input shaft 130 is seated in throughbore 162 of disk 160 with the axis 115 coaxially aligned with the axis 161. Downhole end 130*a* is secured to disk 160 such that shaft 130 and disk 160 cannot rotate relative to each other (i.e., rotational torque is transferred between shaft 130 and disk 160). Therefore, disk 152 rotates with shaft 70 and shaft 130 rotates with disk 160.

Figure 4:
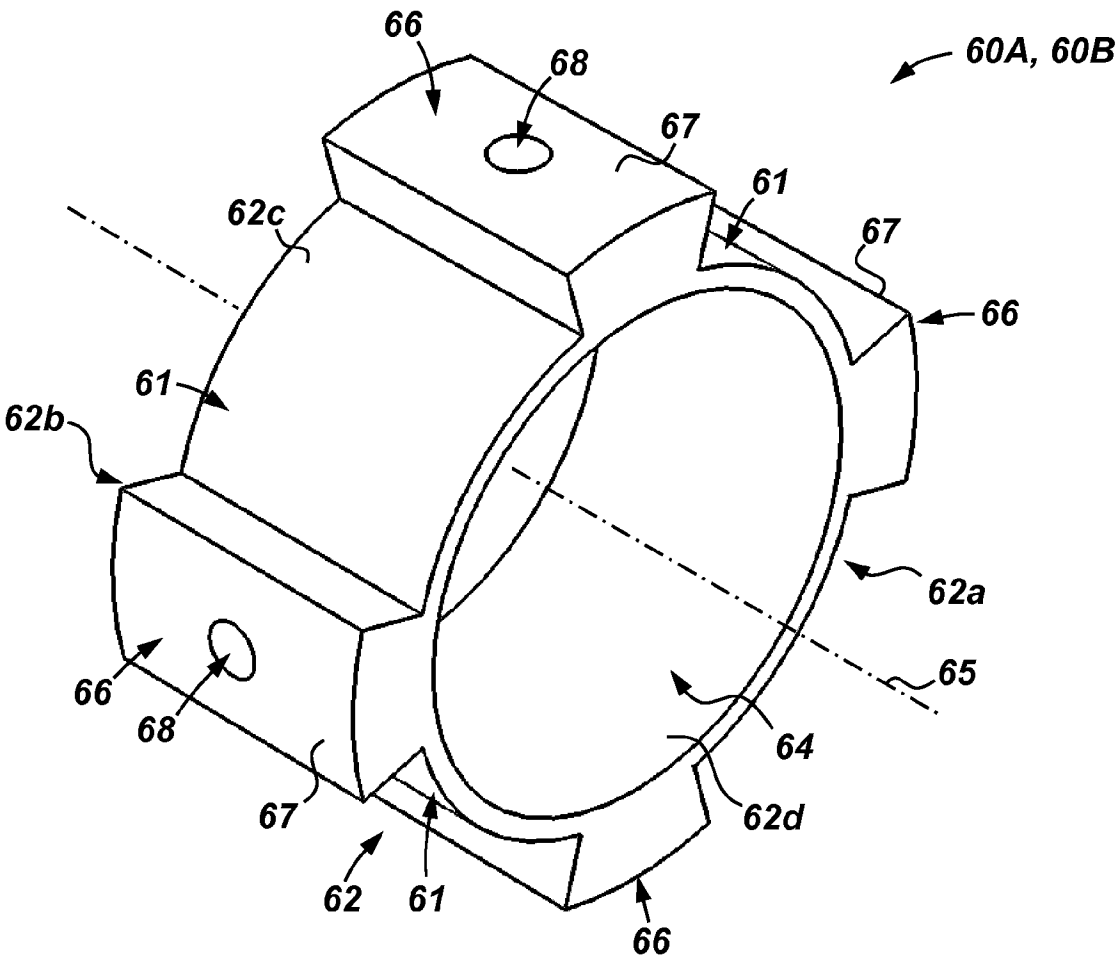
FIG. 4 is a perspective view of one of the centralizers utilized within the power generation assembly of FIG. 1.

Referring now to FIG. 4, as previously described, centralizers 60A, 60B maintain the radial position and coaxial alignment of power generation assembly 100 and coupling section 140. In this embodiment, each centralizer 60A, 60B comprises a generally cylindrical body 62 having a central or longitudinal axis 65, a first end 62*a*, a second end 62*b* opposite the first end 62*a*, a radially outer surface 62*c* extending axially between ends 62*a*, 62*b*, and a radially inner surface 62*d* extending axially between ends 62*a*, 62*b* Inner surface 62*d* defines a cylindrical throughbore 64 extending axially through body 62. Outer surface 62*c* includes a plurality of circumferentially-spaced radial projections 66. In this embodiment, each projection 66 extends axially between ends 62*a*, 62*b*. Projections 66 define a plurality of circumferentially-spaced channels 61 extending axially between ends 62*a*, 62*b*. Each projection 66 has a radially outermost bearing surface 67. An internally threaded counterbore 68 extends radially inward into each projection 66 from the corresponding outer surface 67. In this embodiment, a total of four uniformly circumferentially-spaced projections 66 angularly spaced 90° apart are provided. However, in other embodiments, the number and circumferential spacing of the projections (e.g., projections 66) can be varied.

Referring now to FIGS. 2 and 4, centralizers 60A, 60B are coaxially mounted within housing 110. In particular, each centralizer 60A, 60B is disposed within throughbore 126 of housing 110 such that bearing surfaces 67 slidingly engage with inner surface 110*c*. As is shown in FIG. 2, centralizer 60A is disposed uphole of centralizer 60B such that outer housing 122 of generator 120 is received within throughbore 64 of centralizer 60A, and outer housing 144 of coupling assembly 150 is received within throughbore 64 of centralizer 60B. Thus, centralizers 60A, 60B ensure proper radial positioning of generator 120, and assembly 150, respectively within throughbore 126 of housing 110. A plurality of coupling members 69 are advanced through housing 110 and threaded into mating counterbores 68 to maintain the axial position of centralizers 60A, 60B. Thereafter, drilling fluid is flowed along housing 110, and through channels 61 such that it may be routed elsewhere along drill string 21 (see FIG. 1).

Referring again to FIGS. 1-3, and 5, during downhole operations, drilling fluid (e.g., drilling mud) is pumped from the surface 15 down drillstring 21 toward bit 90. In route to bit 90, the drilling fluid flows through housing 110 and power section 50. Within housing 110, the drilling fluid flows through the annular space formed between the generator 120, coupling section 140, and radially inner surface 110*c* of housing 110. Then, the drilling fluid flows between the radially outer surface 56*c* of rotor 56 and the radially inner surface 52*d* of stator 52, which causes rotor 56, and hence shaft 70 coupled thereto, to rotate eccentrically about the axis 55. The eccentric rotation of rotor 56 and shaft 70 is transferred through each of the disks 152, 156, 160 of coupling assembly 150 to shaft 130. Because each of the disks 152, 156, 160 can translate radially relative to one another as each rotates about their respective axes 151, 157, 161, when rotational torque is transferred from shaft 70 through assembly 150 to shaft 130, the eccentric rotation of shaft 70 is accommodated by the connection links 170 and disks 152, 156, 160, and converted into the concentric rotation of shaft 130 about axes 55, 115. The rotation of shaft 130 drives generator 120, which produces power (electric or otherwise) for use by other components disposed downhole.

In the manner described, coupling assembly 150 transfers rotational torque from the eccentrically rotating rotor 56 of power section 50 to the concentrically rotating shaft 130 used to drive generator 120. While the coupling assembly 150 has been described to include a total of three disks 152, 156, 160, it should be appreciated that in other embodiments, more or less than three disks may be utilized while still complying with the principles disclosed herein. For example, in some embodiments, only two disks are included with one disk being coupled to the shaft 70 and the other disk being coupled to the output shaft 130. Further, while the coupling assembly 150 has been described to include a total of three connection links 170 between each of the disks 152, 156, 160, it should be appreciated that in other embodiments, more or less than three connection links 170 may be included between each disk 152, 156, 160 while still complying with the principles disclosed herein. Still further, while disks 152, 156, 160 have been shown and described as being substantially circular in cross-section, it should be appreciated that disks 152, 156, 160 may be formed into a wide variety of shapes while still complying with the principles disclosed herein. For example, in some embodiments, disks 152, 156, 160, or combinations thereof, may be triangular, rectangular, oval, or polygonal in cross-section.

In system 10 described above, assembly 150 is employed to transfer rotational torque from eccentrically rotating rotor 56 of motor 30 to concentrically rotating shaft 130, which in turn drives generator 120. However, embodiments of coupling assemblies described herein (e.g., assembly 150) can also be used to transfer rotational torque between other eccentrically rotating components (e.g., rotor 56) and concentrically rotating components (e.g., bit 90). For example, referring now to FIG. 8, wherein a power section 50' is shown coupled to a drill bit 90 through a coupling section 240, and bearing assembly 80. Power section 50' is substantially the same as power section 50, previously described except that uphole ends 52*a*, 56*a* of stator 52 and rotor 56, respectively are each substantially disposed downhole of the downhole ends 52*b*, 56*b*, respectively. Thus, in this embodiment shaft 70 extends substantially downhole of rotor 56 rather than uphole as shown in the embodiment of FIGS. 2 and 3.

Figure 8:
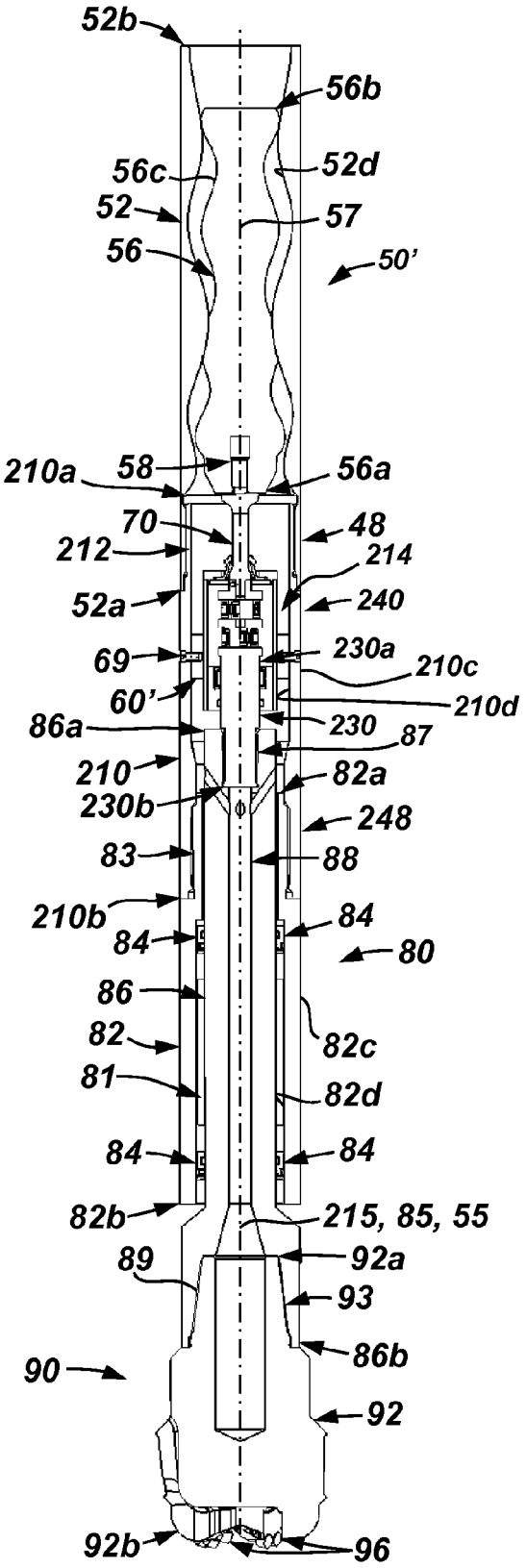
FIG. 8 is a schematic cross-sectional view of the coupling section of FIG. 2 placed between a power section and a drill bit in accordance with the principles disclosed herein.

Referring still to FIG. 8, bearing assembly 80 comprises an outer housing 82 including a central longitudinal axis 85, a first or uphole end 82*a*, a second or downhole end 82*b* opposite the uphole end 82*a*, a radially outer surface 82*c* extending axially between the ends 82*a*, 82*b*, and a radially inner surface 82*d* also extending axially between the ends 82*a*, 82*b* Inner surface 82*d* defines a throughbore 81 that extends between the ends 82*a*, 82*b* along axis 85. In this embodiment uphole end 82*a* comprises a threaded male pin-end connector 83 that threadably engages a housing 210 of coupling section 240 during operation. A drive shaft 86 is rotatably disposed within throughbore 81 along axis 85 and includes a first or uphole end 86*a*, a second or downhole end 86*b* opposite the uphole end 86*a*, an internally threaded counterbore 87 extending axially from uphole end 86*a*, and a central passage 88 extending axially between counterbore 87 and end 86*b*. Downhole end 86*b* comprises an internally threaded female box-end connector 89 that threadably engages with a pin-end connector 93 of drill bit 90 during operations. An output shaft 230 having a first or uphole end 230*a* and a second or downhole end 230*b* opposite the uphole end 230*a* is coupled to uphole end 86*a* of driveshaft 86 such that shaft 230 is aligned with the axis 85. In particular, external threads on shaft 230 engage with the internal threads within counterbore 87 to secure shaft 230 to shaft 86 during operations.

Bit 90 may be any suitable type of bit for boring or drilling a bore hole (e.g., borehole 16) within a subterranean formation. In this embodiment, bit 90 is a fixed cutter bit generally including a body 92 having a first or uphole end 92*a*, and a second or downhole end 92*b* opposite the uphole end 92*a*. Downhole end 92*b* comprises a plurality of cutter elements 96 that are configured to engage the subterranean formation in order to lengthen a borehole, while uphole end 92*a* includes an externally threaded pin-end connector 93 that threadably engages the internal threads housed within box-end connector 83 on shaft 86 such that body 92 of bit 90 is substantially aligned with axes 215, 85.

Figure 9:
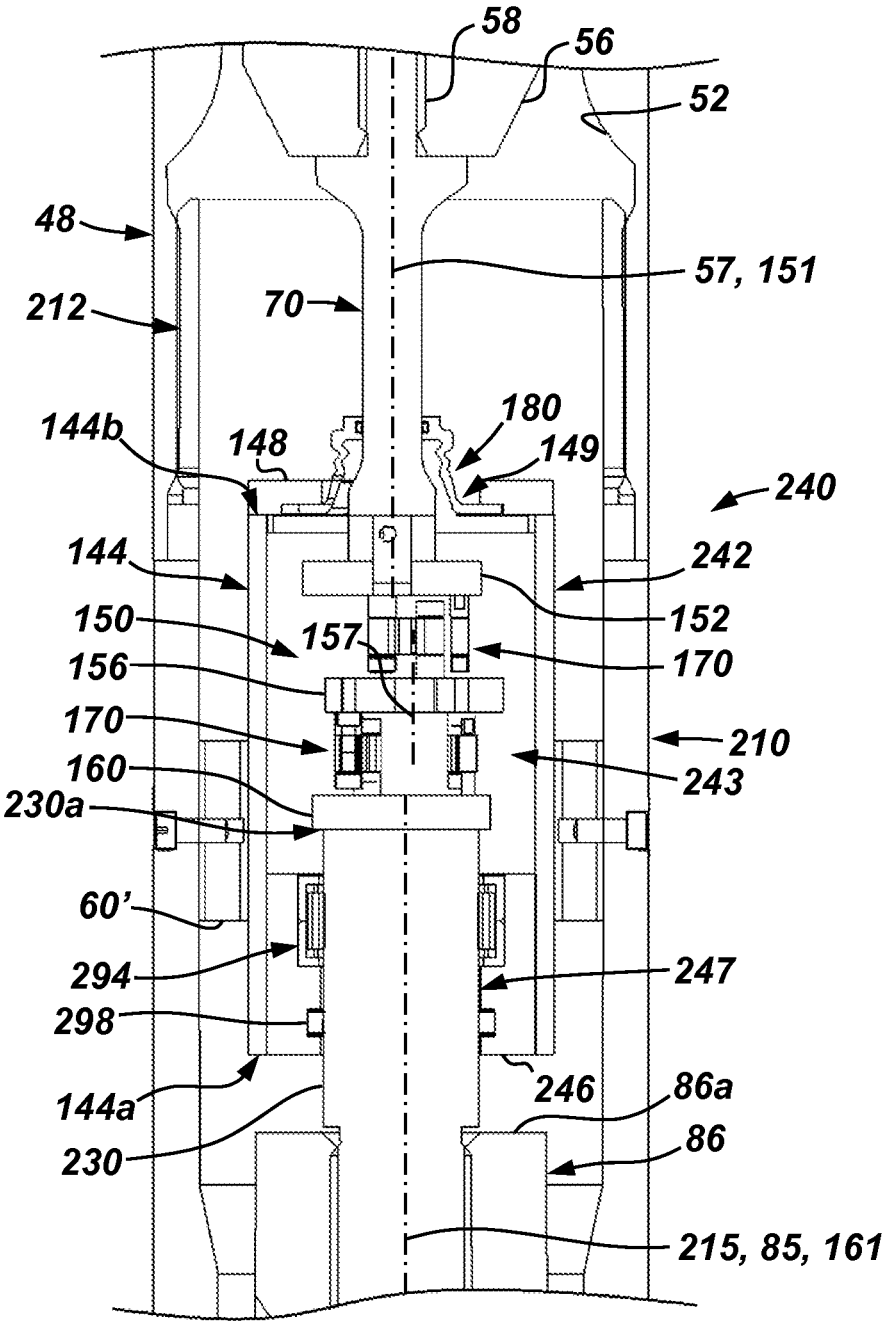
FIG. 9 is an enlarged, schematic cross-sectional view of the coupling section of FIG. 8.

Referring now to FIGS. 8 and 9, coupling section 240 includes an outer housing 210, an inner housing 242, and a coupling assembly 150, as previously described, disposed within housing 242. Outer housing 210 extends axially between power section 50 and bearing assembly 80 and includes a central, longitudinal axis 215 that is aligned with the axis 85 of assembly 80 during operation, a first or uphole end 210*a*, a second or downhole end 210*b* opposite the uphole end 210*a*, a radially outer surface 210*c* extending axially between the ends 210*a*, 210*b*, and a radially inner surface 210*d* also extending axially between the ends 210*a*, 210*b* thereby defining a throughbore 214. Uphole end 210*a* comprises an externally threaded male pin-end connector 212 that threadably engages with box-end connector 48 of power section 50; while downhole end 210*b* comprises an internally threaded female box-end connector 248 that threadably engages with pin-end connector 83 of bearing assembly 80.

Inner housing 242 is substantially the same as housing 142 previously described except that housing 242 includes a plug or cap 246 in place of cap 146, previously described. Cap 246 includes a central passage or port 247 that further includes a radial bearing 294 and a sealing assembly 298. Together, body 144 and caps 246, 148 define an inner space or cavity 243 within housing 242. In addition, as will be described in more detail below, output shaft 230 is received within port 247 such that radial loads experienced by shaft 230 are taken up by radial bearing 294, and sealing assembly 298 restricts the flow of fluids into or out from cavity 243 between shaft 230 and port 247 during operation. Further, the radial position of inner housing 242 within outer housing 210 is maintained by centralizer 60' that is substantially the same as each of the centralizers 60A, 60B, previously described (see FIG. 4).

Coupling assembly 150 is substantially the same as previously described above for the embodiment shown in FIGS. 2-7, except that disk 160 is coupled to output shaft 230 rather than shaft 130 (See FIGS. 2 and 3). In particular, in this embodiment uphole end 230*a* of shaft 230 is monolithically formed with disk 160; however, it should be appreciated that in other embodiments, disk 160 and shaft 230 are not monolithically formed. Thus, as is substantially described above, in this embodiment shaft 70 is coupled to disk 152 such that axis 151 is substantially aligned with the axis 57 and shaft 70 and disk 152 cannot rotate relative to each other (i.e., rotational torque is transferred between shaft 70 and disk 152). In addition, in this embodiment, uphole end 230*a* is secured to disk 160 such that axis 161 is aligned with axes 215, 85 and shaft 230 and disk 160 cannot rotate relative to each other (i.e., rotational torque is transferred between shaft 230 and disk 160). Therefore, disk 152 rotates with shaft 70 and shaft 230 rotates with disk 160.

Referring again to FIGS. 1 and 8-9, during downhole operations, drilling fluid (e.g., drilling mud) is pumped from the surface 15 down drillstring 21 toward bit 90. In route to bit 90, the drilling fluid flows between the radially outer surface 56*c* of rotor 56 and the radially inner surface 52*d* of stator 52, which causes rotor 56, and hence shaft 70 coupled thereto, to rotate eccentrically about the axis 55. The eccentric rotation of rotor 56 and shaft 70 is transferred through each of the disks 152, 156, 160 of coupling assembly 150 to shaft 230. Since each of the disks 152, 156, 160 can translate radially relative to one another as each rotates about their respective axes 151, 157, 161, as rotational torque is transferred from shaft 70 through assembly 150 to shaft 130, the eccentric rotation of shaft 70 is accommodated by the connection links 170 and disks 152, 156, 160, and converted into the concentric rotation of shaft 230 about axes 215, 85, 55. Then, the rotation of shaft 230 drives driveshaft 86 and bit 90 to each also rotate concentrically about axes 215, 85, 55 such that bit 90 engages the underground formation to therefore lengthen borehole 16.

While the embodiment shown in FIGS. 2-7 and the embodiment shown in FIGS. 8-9 have been described separately, it should be appreciated that in some embodiments, both the embodiment shown in FIGS. 2-7 and the embodiment shown in FIGS. 8-9 may be utilized together within a single drilling system (e.g., system 10). For example, in at least some of these embodiments, the rotor (e.g., rotor 56) of a downhole power section (e.g., power section 50, 50') may be coupled to a power generation assembly (e.g., assembly 100) at an uphole end through a coupling assembly (e.g., assembly 150) in the manner shown in FIGS. 2 and 3 and may simultaneously be coupled to a bearing assembly (e.g., assembly 80) and drill bit (e.g., bit 90) at a downhole end through another coupling assembly (e.g., assembly 150) in the manner shown in FIGS. 8 and 9. Further, it should also be appreciated that the embodiment shown in FIGS. 2-7 may also be utilized separately from the embodiment shown in FIGS. 8-9 while still complying with the principles disclosed herein.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole power generation assembly, comprising:

a generator;

a first shaft coupled to the generator, wherein the first shaft has a first central axis, and wherein rotation of the first shaft is configured to drive the generator to produce power;

a second shaft having a second central axis that is oriented parallel to the first central axis and radially offset from the first central axis, wherein the second shaft is configured to be coupled to an end of a rotor of a downhole motor; and a coupling section coupling the first shaft to the second shaft and configured to transfer rotational torque from the second shaft to the first shaft;

wherein the coupling section includes:

a first rotation member coupled to the first shaft and coaxially aligned with the first central axis;

a second rotation member coupled to the second shaft and coaxially aligned with the second central axis;

a third rotation member axially positioned between the first rotation member and the second rotation member, wherein the third rotation member is coupled to the first rotation member and the second rotation member, and wherein the third rotation member has a third central axis oriented parallel to the first central axis and the second central axis; and wherein the third rotation member is configured move radially relative to the first rotation member and the second rotation member as each of the first rotation member, second rotation member, and third rotation member rotate about the first central axis, the second central axis, and the third central axis, respectively.

2. The assembly of claim 1, wherein the third rotation member is coupled to the first rotation member with a first plurality of circumferentially spaced connection links; and wherein the third rotation member is coupled to the second rotation member with a second plurality of circumferentially spaced connection links.

3. The assembly of claim 2, wherein each of the first plurality of connection links is pivotally coupled to the first rotation member and pivotally coupled to the third rotation member; and wherein each of the second plurality of connection links is pivotally coupled to the second rotation member and pivotally coupled to the third rotation member.

4. The assembly of claim 3, wherein each connection link comprises a connection member having a first end and a second end;

wherein the first end of each connection member of the first plurality of connection links is pivotally coupled to the first rotation member and the second end of each connection member of the first plurality of connection links is pivotally coupled to the third rotation member; and wherein the first end of each connection member of the second plurality of connection links is pivotally coupled to the second rotation member and the second end of each connection member of the second plurality of connection links is pivotally coupled to the third rotation member.

5. The assembly of claim 4, wherein the first end of each connection member includes a first throughbore oriented parallel to both the first central axis and the second central axis;

wherein the second end of each connection member includes a second throughbore oriented parallel to both the first central axis and the second central axis; and wherein a pin is rotatably disposed in the first throughbore of each connection member and a pin is rotatably disposed in the second throughbore of each connection member.

6. The assembly of claim 1, further comprising:

a housing configured to be coupled to an end of a stator of the downhole motor, wherein the generator is disposed in the housing.

7. The assembly of claim 6, wherein the first shaft and the coupling section are disposed in the housing.

8. The assembly of claim 6, wherein the second shaft is configured to be coupled to an uphole end of the rotor and the housing is configured to be coupled to an uphole end of the stator.

9. The downhole motor of claim 6, further comprising:

a first centralizer radially positioned between the housing and the generator and configured to centralize the generator within the housing;

a second centralizer radially positioned between the housing and the coupling section and configured to centralize the coupling section within the housing.

10. A drilling system, comprising:

a drillstring;

a power section coupled to a lower end of the drillstring and including:

a stator having a central axis; and a rotor rotatably disposed in the stator, wherein the rotor has a central axis that is oriented parallel to the central axis of the stator and radially offset from the central axis of the stator;

wherein the rotor is configured to rotate eccentrically relative to the stator in response to the flow of drilling fluid therebetween;

a coupling section including:

a first rotation member having a first rotation axis;

a second rotation member axially spaced from the first rotation member and having a second rotation axis;

a third rotation member axially positioned between the first rotation member and the second rotation member and having a third rotation axis, wherein the third rotation member is coupled to the first rotation member and the second rotation member;

wherein the first rotation axis, the second rotation axis, and the third rotation axis are each oriented parallel to the central axis of the stator; and wherein the third rotation member is configured to move radially relative to the first rotation member and the second rotation member as each of the first rotation member, the second rotation member, and the third rotation member rotate about the first rotation axis, the second rotation axis, and the third rotation axis, respectively; and an input shaft having a first end coupled to the rotor and a second end coupled to the first rotation member, wherein the input shaft and the first rotation member are configured to rotate with the rotor eccentrically relative to the central axis of the stator and the second rotation member is configured to rotate concentrically relative to the central axis of the stator and the second rotation axis.

11. The drilling system of claim 10, wherein the first rotation member is coupled to the third rotation member with a first plurality of circumferentially spaced connection links axially disposed between the first rotation member and the third rotation member; and wherein the second rotation member is coupled to the third rotation member with a second plurality of circumferentially spaced connection links axially disposed between the second rotation member and the third rotation member.

12. The drilling system of claim 11, wherein each connection link comprises a linking member having a first end and a second end opposite the first end; and wherein each linking member of the first plurality of connection links is rotatably coupled to the first rotation member and the third rotation member, and wherein each linking member of the second plurality of connection links is rotatably coupled to the second rotation member and the third rotation member.

13. The drilling system claim 12, wherein the first end of each linking member of the first plurality of connection links is pivotally coupled to the first rotation member and the second end of each linking member of the first plurality of connection links is pivotally coupled to the third rotation member; and wherein the first end of each linking member of the second plurality of connection links is pivotally coupled to the second rotation member and the second end of each linking member of the second plurality of connection links is pivotally coupled to the third rotation member.

14. The drilling system of claim 10, wherein the second rotation member is coupled to a drill bit and is configured to transfer rotational torque to the drill bit.

15. The drilling system of claim 10, wherein the second rotation member is coupled to a generator and is configured to drive the generator to produce power.

16. The drilling system of claim 15, further comprising:

an outer housing coupled to the stator and coaxially aligned with the central axis of the stator, wherein the coupling section and the generator are disposed in the outer housing; and an output shaft coupled to the second rotation member and the generator, wherein the output shaft is configured to rotate concentrically within the outer housing to drive the generator.

17. The drilling system of claim 16, wherein the outer housing is coupled to an uphole end of the stator and the input shaft is coupled to an uphole end of the rotor.

18. A method for rotating a downhole component concentrically relative to a central axis of a drillstring, the method comprising:

(a) flowing fluid through a stator having a rotor rotatably disposed therein, wherein the stator has a central stator axis and the rotor has a central rotor axis that is radially offset from the central axis of the stator;

(b) rotating the rotor about the rotor axis and orbiting the rotor axis about the stator axis during (a);

(c) rotating a first rotation member that is coupled to the rotor about the rotor axis during (b);

(d) rotating a second rotation member, that is coupled to the first rotation member with a first plurality of connection links, about an axis of rotation that is parallel and radially offset from each of the rotor axis and the stator axis during (b);

(e) rotating a third rotation member, that is coupled to the second rotation member with a second plurality of connection links, about the stator axis during (b); and (f) radially moving the second rotation member relative to the first rotation member and the second rotation member during (b).

19. The method of claim 18, wherein each of the first plurality of connection links comprises a linking member having a first end and a second end opposite the first end; wherein the first end of each of the linking members of the first plurality of connection links is rotatably coupled to the first rotation member, wherein the second end of each of the linking members of the first plurality of connection links is rotatably coupled to the second rotation member; and wherein (d) further comprises:

(d1) rotating each of the linking members about the first end; and (d2) rotating each of the linking members about the second end.

20. The method of claim 18, further comprising:

(g) rotating a drill bit that is coupled to the third rotation member about the stator axis during (e).

* * * * *